US007628886B2

(12) United States Patent
Endo et al.

(10) Patent No.: US 7,628,886 B2
(45) Date of Patent: Dec. 8, 2009

(54) PROCESS FOR PRODUCING CAST COATED PAPER FOR INK JET RECORDING

(75) Inventors: Shoichi Endo, Tokyo (JP); Yoshio Yoshida, Tokyo (JP); Kazuhiro Iwasaki, Tokyo (JP); Jiro Yoshimura, Tokyo (JP)

(73) Assignee: Nippon Paper Industries CO., Ltd., Tokyo (JP)

( * ) Notice: Subject to any disclaimer, the term of this patent is extended or adjusted under 35 U.S.C. 154(b) by 550 days.

(21) Appl. No.: 10/509,374

(22) PCT Filed: Mar. 27, 2003

(86) PCT No.: PCT/JP03/03871

§ 371 (c)(1),
(2), (4) Date: Jun. 15, 2005

(87) PCT Pub. No.: WO03/082592

PCT Pub. Date: Oct. 9, 2003

(65) Prior Publication Data

US 2005/0230070 A1 Oct. 20, 2005

(30) Foreign Application Priority Data

Mar. 29, 2002 (JP) ..... 2002-097275

(51) Int. Cl.
*B05D 3/12* (2006.01)
*D21H 19/44* (2006.01)
*D21H 19/64* (2006.01)

(52) U.S. Cl. ..... 162/136; 162/158; 162/181.2; 427/362

(58) Field of Classification Search ..... 162/135–137, 162/158, 164.1, 181.1, 181.4, 168.1; 427/361, 427/362, 391, 355, 428.01
See application file for complete search history.

(56) References Cited

U.S. PATENT DOCUMENTS 3,110,612 A * 11/1963 Gottwald et. al. ..... 427/362
3,224,897 A * 12/1965 Smith ..... 427/362
4,048,380 A * 9/1977 Blakey et al. ..... 428/511
4,515,833 A 5/1985 Nojima et al.
4,581,257 A * 4/1986 Kondo et al. ..... 427/336

(Continued)

FOREIGN PATENT DOCUMENTS

EP 1498278 A1 * 1/2005

(Continued)

*Primary Examiner*—José A Fortuna
(74) *Attorney, Agent, or Firm*—Millen, White, Zelano & Branigan, P.C.

(57) ABSTRACT

A method of manufacturing an inkjet recording cast-coated paper wherein a coating solution containing a pigment and a binder resin is supplied to a base paper, a treatment solution having the function of solidifying the binder resin is supplied to the coating layer while it is still wet in order to solidify the coating layer, and the wet, solidified coating layer is brought into pressure contact with the mirror surface of a heated drum and dried to obtain a cast-coated layer. According to this invention, the treatment solution is supplied by the double pond method wherein the roll is enclosed by the base paper so as to bring the wet coating layer into contact, and ponds of treatment solution are formed both before and after the coating layer comes into contact with the roll.

4 Claims, 2 Drawing Sheets

U.S. PATENT DOCUMENTS

| | | | | | |
|---|---|---|---|---|---|
| 4,620,992 | A | * | 11/1986 | Nojima et al. | 427/362 |
| 4,686,119 | A | * | 8/1987 | Nojima et al. | 427/362 |
| 4,900,583 | A | * | 2/1990 | Hirabayashi et al. | 427/542 |
| 4,929,470 | A | * | 5/1990 | Rittenhouse et al. | 427/557 |
| 5,043,190 | A | * | 8/1991 | Katsumata et al. | 427/362 |
| 5,275,846 | A | * | 1/1994 | Imai et al. | 427/362 |
| 5,523,149 | A | | 6/1996 | Kijimuta et al. | |
| 5,755,929 | A | * | 5/1998 | Kuroyama et al. | 162/137 |
| 5,985,367 | A | * | 11/1999 | Nishijima et al. | 427/361 |
| 6,037,050 | A | | 3/2000 | Saito et al. | |
| 6,051,106 | A | * | 4/2000 | Omura et al. | 162/135 |
| 6,783,804 | B2 | * | 8/2004 | Gilbert | 427/362 |
| 2004/0261964 | A1 | * | 12/2004 | Asano et al. | 162/135 |
| 2005/0230070 | A1 | * | 10/2005 | Endo et al. | 162/135 |
| 2007/0221349 | A1 | * | 9/2007 | Ohira et al. | 162/137 |

FOREIGN PATENT DOCUMENTS

| | | | | |
|---|---|---|---|---|
| JP | 61-194295 | A | * | 8/1986 |
| JP | 04300399 | A | * | 10/1992 |
| WO | WO 03/082592 | A1 | * | 10/2003 |

* cited by examiner

PROCESS FOR PRODUCING CAST COATED PAPER FOR INK JET RECORDING

FIELD OF THE INVENTION

This invention relates to a method of manufacturing an inkjet recording paper, and in particular to a method of manufacturing an inkjet recording cast-coated paper which has a gloss comparable to that of a silver halide photograph and which produces very little edge dust when cut.

BACKGROUND OF THE INVENTION

In general, in inkjet recording methods, recording is performed by spraying ink droplets from various devices, and the droplets adhere to a recording paper so as to form dots. The advantages of inkjet recording as compared to dot impact printing are that it is noiseless, it is easy to adapt to full color, and high-speed printing can be performed. On the other hand, ink jet recording has the disadvantage that, as the inks used are normally water-based inks which use direct dyes or acidic dyes, drying properties are poor.

Recently, due to the popularity of high-resolution digital video recorder, digital cameras, scanners and personal computers, there are more opportunities to handle fine detail images. Correspondingly, inkjet printers have recently become increasingly high performance, and images comparable to those of a silver halide photograph can be output by inkjet printers. Hence, these fine detail images are now frequently output by inkjet printers. Another consequence has been a diversification of the properties required of recording media, and there is increasing demand for an inkjet recording medium having a gloss comparable to that of a silver halide photograph which permits high quality image recording.

A method for manufacturing an inkjet recording paper satisfying these properties which permits high image quality recording by the cast coating method has already been disclosed (Tokkai-Sho 62-95285, ibid 63-264391, Tokkai-Hei 2-274587,ibid. 5-59694). Inkjet recording cast-coated papers which permit high image quality recording have high ink absorption properties, which is a basic requirement for high image quality, by reducing a density of the recording layer relatively low.

However, in these inkjet recording cast-coated papers, as the cast-coated layer is porous, it is weaker than the cast-coated layers of cast-coated papers for ordinary printing purposes. In particular, as a cast-coated layer which contains alumina as a pigment and polyvinyl alcohol as a binder has high transparency and excellent gloss, it is extremely suitable for inkjet recording, but its surface strength is weaker than when another pigment or binder is used, so the coated layer tended to fall off during cutting or handling, and give cause of edge dust. If edge dust adheres to the recording layer surface of the recording paper, image defects occur when recording is performed with an inkjet printer. If the blending ratio of the binder is increased to increase the strength of the cast-coated layer, ink absorption properties are insufficient. Therefore, an inkjet recording cast-coated paper having excellent ink absorption properties but produce minimal edge dust was desired.

It is therefore an object of this invention to provide a method of obtaining an inkjet recording cast-coated paper having satisfactory ink absorption properties and inkjet recording properties, but produce minimal edge dust when it is cut.

SUMMARY OF THE INVENTION

The aforesaid object of the invention is attained by a method of manufacturing an inkjet recording cast-coated paper wherein a coating solution containing a pigment and a binder resin is supplied to a base paper, a treatment solution having the function of solidifying the binder resin is supplied to the coating layer while it is still wet in order to solidify the coating layer, the wet, solidified coating layer is brought into pressure contact with the mirror surface of a heated drum and dried to obtain a cast-coated layer, wherein the roll is enclosed by the base paper to bring the wet coating layer into contact, and ponds of treatment solution are formed both before and after the coating layer comes into contact with the roll.

When the treatment solution is supplied to the aforesaid ponds, the treatment solution is preferably supplied from above the roll which applies the treatment solution so that it falls over the roll. Further, the coating solution preferably contains at least gamma-alumina and polyvinyl alcohol as the pigment and binder resin, respectively.

DESCRIPTION OF SYMBOLS

In the figure, 1 is a roll, 2 is a base paper provided with a coating layer, 3 is a treatment solution pond, 4 is a treatment solution supply device and 5 is a guide member.

DESCRIPTION OF THE PREFERRED EMBODIMENTS

Figure 1:
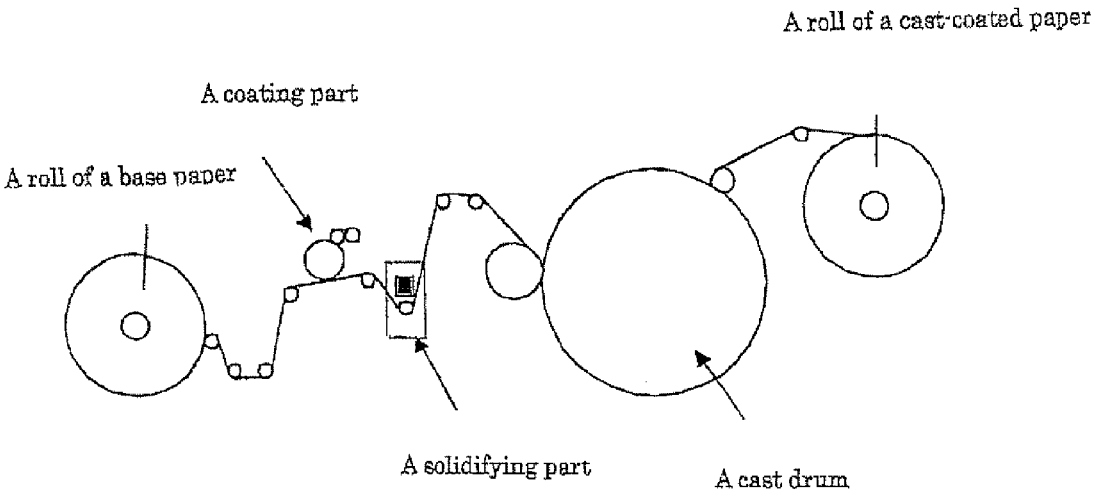
FIG. 1 is a schematic view of a solidification cast coating machine used in this invention.
Figure 2:
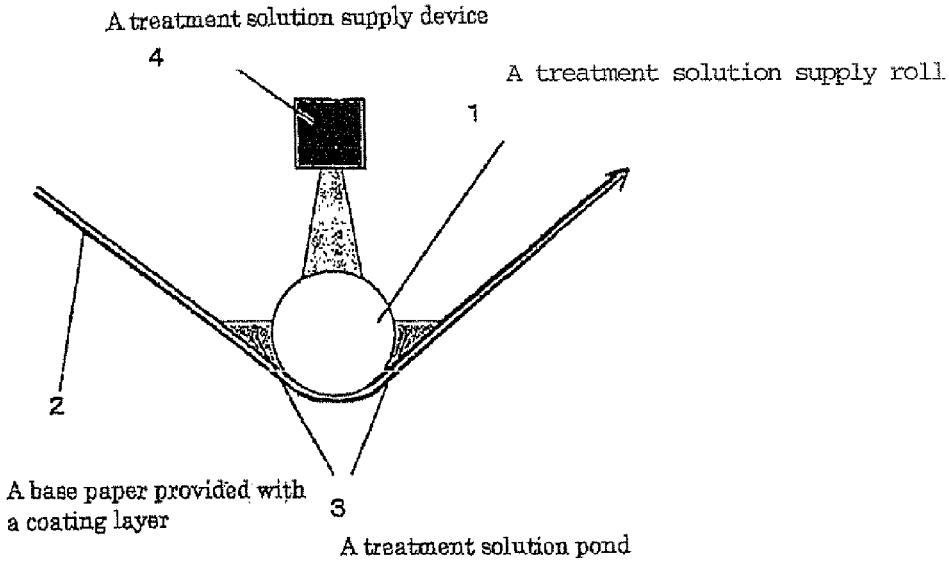
FIG. 2 is an enlarged view of a solidifying part.

Hereafter, this invention will be described in detail referring to the drawings. FIG. 2 is a conceptual view of the situation when the treatment solution is supplied to the coating layer. In this invention, the roll 1 is enclosed by the base paper 2 provided with the wet coating layer, and ponds 3 of treatment solution are formed before and after the part where the roll 1 and the coating layer come into contact to apply the treatment solution to the coating layer. Hereafter, this treatment solution application method shall be referred to as the double pond method.

In the prior art solidification cast coating method, a pond (liquid pool) of treatment solution was formed only on the paper advance side (forward side) (hereafter, this treatment solution application method will be referred to as the single pond method), but in this invention, a pond of treatment solution is formed also on the opposite side to the advance direction of the paper.

In this invention, by thus applying the treatment solution by the double pond method, the strength of the inkjet cast-coated layer can be enhanced without sacrificing good ink absorption properties, which was difficult to achieve in the prior art.

The effect of this invention is particularly pronounced in the case of a coating layer containing alumina and polyvinyl alcohol.

(Base Paper)

In this invention, paper comprising mainly pulp and a filler (coated paper or uncoated paper) is used. The raw material pulp for this paper may be a chemical pulp (bleached or unbleached craft pulp from needle-leaved tree (coniferous trees), bleached or unbleached craft pulp from broad-leaved trees (deciduous trees), mechanical pulp (hardwood pulp, thermomechanical pulp, chemithermomechanical pulp) or deinked pulp, any of which may be used alone, or blended together in a desired ratio. The pH of the paper may be acid, neutral or alkaline. The opacity of the paper is preferably increased by containing a filler in the paper. This filler may be suitably selected from among those known in the art such as hydrated silicic acid, white carbon, talc, kaolin, clay, calcium carbonate, titanium oxide or a powder of synthetic resin.

(Pigment)

The pigment used in the recording layer of this invention may be a pigment used in prior art of coated papers, i.e., inorganic or organic particulates known in the art. In particular, from the viewpoint of improving suitability for inkjet recording, alumina is preferably used. This alumina is the aluminum oxide obtained for example by sintering aluminum hydroxide. Many crystalline forms of alumina are known, e.g., α-alumina, β-alumina and γ-alumina. In this invention, from the viewpoint of enhancing scratch properties of the image part, γ-alumina is preferably used. Also, in this invention, to the extent that there is no loss of gloss and color during inkjet recording, other pigments such as α crystalline alumina, θ crystalline alumina, synthetic silica, kaolin, talc, calcium carbonate, titanium dioxide, clay or zinc oxide may be used in conjunction.

(Binder Resin)

The recording layer in the recording layer of this invention may contain a resin (natural resin, synthetic resin) known in the art commonly used in prior art of coated papers. In this invention, from the viewpoint of ink color, the use of polyvinyl alcohol is particularly preferred. Provided that it reacts sufficiently with the treatment solution, the polyvinyl alcohol may be suitably selected as regarding saponification degree and polymerization degree. In this invention, in addition to polyvinyl alcohol, and to the extent that it does not interfere with the effect of the invention, starches such as oxidized starch and esterified starch, cellulose derivatives such as carboxymethylcellulose and hydroxyethylcellulose, polyvinyl pyrrolidone, casein, gelatin, soya bean protein, styrene-acrylic resin and its derivatives, styrene-butadiene latex, acrylic emulsion, vinyl acetate emulsion, vinyl chloride emulsion, urethane emulsion, urea emulsion, alkyd emulsion and derivatives thereof may also be blended. Further, the blending amount of the resin component in the recording layer is preferably 5 parts by weight—30 parts by weight relative to 100 parts by weight of pigment, but the aforesaid range is not limiting provided that the required coating layer strength is obtained.

(Treatment Solution)

In this invention, the treatment solution used for solidification is not particularly limited provided that it is an aqueous solution containing a compound having the function of solidifying the aforesaid binder resin. In particular, if the binder resin is polyvinyl alcohol, a treatment solution containing boric acid and a borate is preferred. Examples of borates which can be used in this invention are borax, orthoborates, diborates, metaborates, pentaborates and octaborates, but the borate is not particularly limited to these examples. From the viewpoint of ease of procuring material and low cost, the use of borax is particularly preferred. Boric acid and a borate may respectively be used alone, but several types may also be used in admixture with each other.

If only the borate in the treatment solution is used, the polyvinyl alcohol in the coating layer solidifies too hard, so when the coating layer is pressed in contact with the heated mirrors surface drum via a press roll, and dried, the glossy surface of the drum cannot be properly duplicated, and it is difficult to obtain a satisfactory glossy surface. Even if the borate concentration in the treatment solution is decreased, there is no change as to the degree of solidification of the polyvinyl alcohol, so it is difficult to obtain a satisfactory glossy surface.

On the other hand, when the boric acid alone is used in the treatment solution, it is difficult to obtain the preferable recording layer because incomplete solidification of polyvinyl alcohol in the coating layer makes the partially solidified coating layer stick to the solidifying solution supply roll. When the concentration of boric acid in the treatment solution is getting higher, polyvinyl alcohol tends to oversolidify. However, it is difficult to solidify the polyvinyl alcohol to the preferable degree because the solubility of boric acid is low.

By using a mixture of boric acid and a borate, it is easy to obtain a coating layer which is solidified to a suitable degree of hardness, and a cast-coated paper for inkjet recording having a satisfactory gloss can be obtained. Also, by mixing a borate with boric acid, the solubility of the boric acid in water is enhanced compared to the case where boric acid is used alone, so the solidification state of the polyvinyl alcohol can easily be adjusted.

It is particularly preferred that the blending ratio by weight of borates and boric acid in the treatment solution is borate/boric acid=0.25/1-2/1. If the proportion of boric acid is too large, solidification of the polyvinyl alcohol in the coating layer is incomplete, so the partially solidified coating layer sticks to the solidifying solution supply roll and a satisfactory recording layer cannot be obtained. On the other hand, if the blending ratio of borate is too high, the polyvinyl alcohol in the recording layer solidifies too hard, so the gloss of the cast-coated paper surface decreases and the gloss tends to become uneven.

The concentrations of the compounds having the function of solidifying the binder resin in the treatment solution may be suitably adjusted according to requirements. If the concentration of the compounds having the function of solidifying the binder resin in the treatment solution is increased, the strength of the cast-coated layer increases. However, if the concentration of these compounds is too high, the degree of solidification of the binder resin increases, gloss deteriorates and the stability of the treatment solution becomes poor.

(Release Agent)

A release agent may, if required, be added to the coating solution and treatment solution used to form the cast-coated layer. The melting point of the added release agent is preferably 90-150° C., but more preferably 95-120° C. Within the above range, the melting point of the release agent is almost identical to the metal surface temperature of the mirror finish, so the function of the release agent can be optimized. The release agent is not particularly limited provided that it has the aforesaid properties. A particularly preferred release agent is polyethylene wax emulsion.

The coating solution or treatment solution which forms the cast-coated layer in this invention may, if required, contain suitable additives such as a pigment dispersant, water retaining agent, thickener, antifoaming agent, preservative, colorant, water resistant additive, wetting agent, fluorescent dye, ultraviolet absorption agent and cationic polymer electrolyte.

The coating solution may be coated on the base paper by a device suitably selected from among coating devices known in the art such as a blade coater, air knife coater, roll coater, brush coater, kiss roll coater, squeeze coater, curtain coater, die coater, bar coater, gravure coater or comma roll coater.

The coating amount of the recording layer may be adjusted as desired provided that it coats the surface of the base paper and provides sufficient ink absorption properties, but from the viewpoint of both recording density and ink absorption properties, it is preferably sufficient to give a dry coverage rate of 5-30 g/m$^2$ per side. If 30 g/m$^2$ is exceeded, release properties from the mirror surface drum deteriorate, and the coating layer may stick to the mirror surface drum. If a large coating amount is required, an underlayer is preferably provided between the base paper and the recording layer.

If the recording layer is dry when the treatment solution is supplied, it is difficult to duplicate the mirror drum surface on the recording layer and minute surface roughness increases, so it is difficult to obtain a gloss comparable to that of a silver halide photograph.

Figure 3:
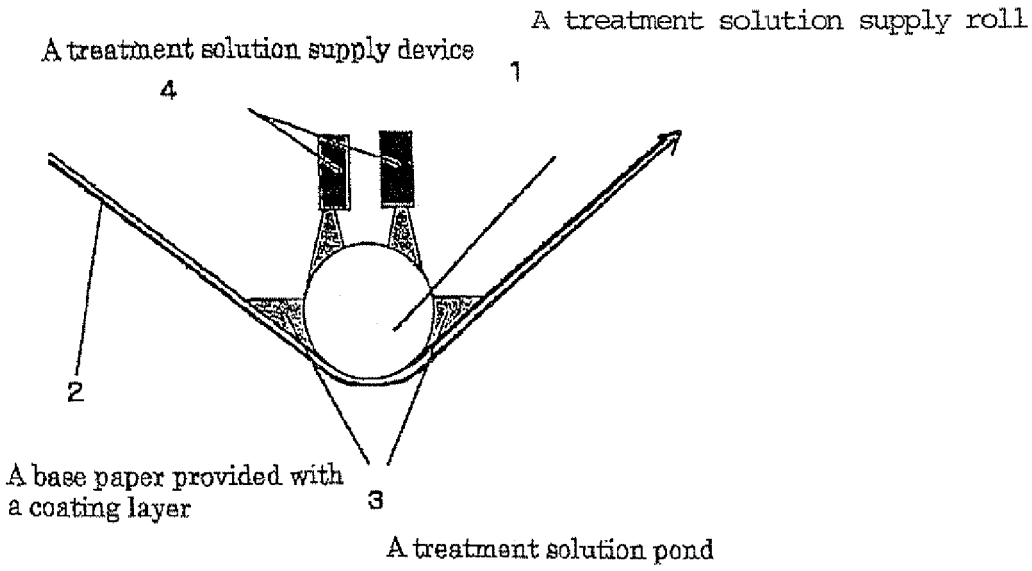
FIG. 3 is a conceptual view when there are plural treatment solution supply devices.
Figure 4:
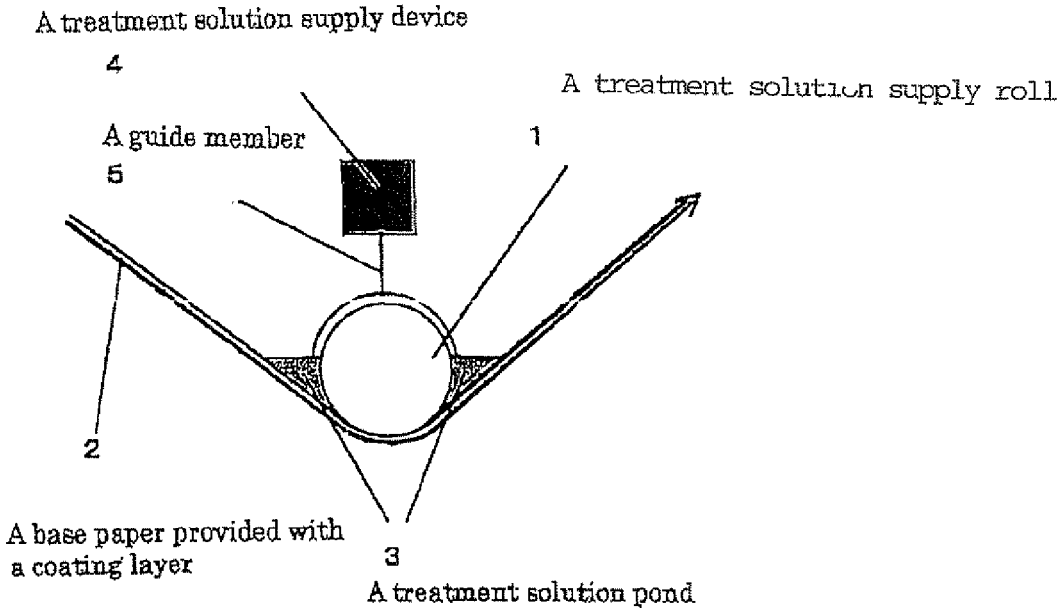
FIG. 4 is a conceptual view when the treatment solution supply device is a guide member.

In this invention, the treatment solution can be supplied to the ponds by any technique known in the art. Also in this invention, it is particularly preferred to supply the treatment solution to the ponds from above the treatment solution supply roll so that it falls over the roll. The method of supplying the treatment solution to the roll is not particularly limited, and may be suitably selected from methods known in the art (e.g., spray method, shower method or curtain method) (FIG. 2, FIG. 3). The ponds can also be formed by supplying the treatment solution to both sides of the roll via a guide member (FIG. 4). "Pond" in this invention means a pool of liquid formed between the treatment solution supply roll and the coated paper. A construction is preferably adopted wherein excess treatment solution can flow out toward both ends of the coated paper.

EXAMPLES

This invention will now be described in more detail referring to specific examples and comparative examples, but it should be understood that the invention is not to be construed as being limited in any way thereby. Also, unless otherwise specified, "parts" and "%" respectively refer to "parts by weight" and "wt %".

Example 1

A slurry was prepared by mixing 10 parts by weight of talc, 1.0 parts by weight of aluminum sulfate, 0.1 parts by weight of a synthetic sizing agent and 0.02 parts by weight of a retention aid with 100 parts of bleached broadleaf craft pulp slurry (L-BKP) having a beating degree of 285 ml c.s.f. A support was made using a paper machine, and starch was coated on both sides of the support to a dry coverage rate of 2.5 g/m$^2$ per side so as to obtain a base paper having a basis weight of 142 g/m$^2$. The following coating solution A was then coated using a blade coater on one side of this base paper to an amount of 8 g/m$^2$, and dried in a current of air at 140° C. Next, the following coating solution B was coated to an amount of 20 g/m$^2$ using a roll coater, on the side which had been coated with coating solution A, and the following solidifying solution C was supplied while the coating layer was still wet to solidify the coating layer. Next, the coating layer was pressed in contact with a heated mirror surface via a press roll to duplicate the mirror surface on the coating layer surface, and an inkjet recording cast-coated paper of 180 g/m$^2$ was thereby obtained.

Coating Solution A:

5 parts of latex (LX438C: commercial name, Sumitomo Chemical Co., Ltd.) as pigment, 20 parts of polyvinyl alcohol (PVA-117: commercial name, Kuraray Co.,Ltd.) and 5 parts of a sizing agent (Polymalon 360: commercial name, Arakawa Chemical Industries Ltd.) were blended with 100 parts of synthetic silica (Fineseal X-37: commercial name, Tokuyama Corp.), so as to prepare an aqueous coating solution having a concentration of 20%.

Coating Solution B:

50 parts of high purity alumina (UA-5605: commercial name, Showa Denko KK) and 50 parts of high purity alumina (AKP-G015: commercial name, Sumitomo Chemical Industries Ltd.) as pigment, and a total of 10 parts of polyvinyl alcohol A having a polymerization degree of 2,400 (Kuraray 224: commercial name, Kuraray Co.,Ltd.) and polyvinyl alcohol B having a polymerization degree of 2,600 (MA26GP: commercial name, Shin-Etsu Chemicals Co., Ltd.) in a ratio of 1:1 as binder, were blended together so as to prepare a coating solution having a concentration of 30%.

Solidifying Solution C:

The solidifying solution was prepared by blending borax/boric acid in a ratio of 1/1 to give a concentration of 1% as $Na_2B_4O_7$ and $H_3BO_3$, and 0.2% of a release agent (FL-48C: commercial name, Toho Chemical Industries Co.,Ltd.).

Example 2

An inkjet recording cast-coated paper was prepared in an identical way to that described in Example 1, except that the total concentration of borax and boric acid in the solidifying solution of Example 1 was 2% as $Na_2B_4O_7$ and $H_3BO_3$.

Example 3

An inkjet recording cast-coated paper was prepared in an identical way to that described in Example 1, except that the total concentration of borax and boric acid in the solidifying solution of Example 1 was 4% as $Na_2B_4O_7$ and $H_3BO_3$.

Example 4

An inkjet recording cast-coated paper was prepared in an identical way to that described in Example 2, except that the pigment of coating solution B used in Example 2 was 75 parts of high purity alumina (UA-5605: commercial name, Showa Denko KK) and 25 parts of silica (Silojet 703C: commercial name, Grace Japan Ltd.).

Example 5

An inkjet recording cast-coated paper was prepared in an identical way to that described in Example 1, except that the blending ratio of borax/boric acid used in Solution C of Example 1 was ½, and the total concentration of borax and boric acid was 4% as $Na_2B_4O_7$ and $H_3BO_3$.

Comparative Example 1

An inkjet recording cast-coated paper was prepared in an identical way to that described in Example 1, except that instead of the double pond method used in Example 1, the single pond method was used.

Comparative Example 2

An inkjet recording cast-coated paper was prepared in an identical way to that described in Example 2, except that instead of the double pond method used in Example 2, the single pond method was used.

Comparative Example 3

An inkjet recording cast-coated paper was prepared in an identical way to that described in Example 3, except that instead of the double pond method used in Example 3, the single pond method was used.

Comparative Example 4

An inkjet recording cast-coated paper was prepared in an identical way to that described in Example 4, except that instead of the double pond method used in Example 4, the single pond method was used.

Comparative Example 5

An inkjet recording cast-coated paper was prepared in an identical way to that described in Example 5, except that instead of the double pond method used in Example 5, the single pond method was used.

The coating properties during manufacture, gloss and edge dust were evaluated for the inkjet recording papers obtained in Examples 1-5 and Comparative Examples 1-5, as follows. The results are summarized in Table 1.

(1) Coating Properties

The soiling of the solidifying solution adhesion roll when coating was performed with a cast coater was visually evaluated as follows:

○: No soiling of solidifying solution supply roll

Δ: A small amount of the coating layer was transferred to the surface of the solidifying solution supply roll due to incomplete solidification X: A large amount of the coating layer was transferred to the surface of the solidifying solution supply roll due to incomplete solidification (2) Gloss The gloss of the cast-coated paper surface was visually evaluated as follows:

○: Highly transparent gloss

Δ: Opaque gloss

X: Low gloss or coating unevenness (3) Edge Dust

The amount of edge dust produced when an A4 (21 cm) sheet was cut 20 times with an unused blade of NT cutter (A-300: commercial name, NT Ltd.).

○: Amount of edge dust less than 10 mg

Δ: Amount of edge dust between 10 mg and 20 mg

X: Amount of edge dust more than 20 mg

TABLE 1

| | Solidifying solution | Solidifying solution concentration % | Coating properties | Gloss | Edge dust amount |
|---|---|---|---|---|---|
| Example 1 | Double pond | 1 | ○ | ○ | Δ |
| Example 2 | Double pond | 2 | ○ | ○ | ○ |
| Example 3 | Double pond | 4 | ○ | ○ | ○ |
| Example 4 | Double pond | 2 | ○ | ○ | ○ |
| Example 5 | Double pond | 4 | ○ | ○ | ○ |
| Comp. Ex. 1 | Single pond | 1 | x | x | x |
| Comp. Ex. 2 | Single pond | 2 | Δ | Δ | x |
| Comp. Ex. 3 | Single pond | 4 | ○ | ○ | x |
| Comp. Ex. 4 | Single pond | 2 | Δ | Δ | x |
| Comp. Ex. 5 | Single pond | 4 | Δ | Δ | x |

As can be seen from Table 1, in the inkjet recording cast-coated paper of this invention wherein the solidifying solution was supplied by the double pond method, very little edge dust was produced. On the other hand, in the inkjet recording cast-coated papers of Comparative Examples 1-5 wherein the solidifying solution was supplied by the single pond method, a large amount of edge dust was produced even if the concentration of borax/boric acid was increased.

INDUSTRIAL APPLICATION

According to this invention, an inkjet recording cast-coated paper having satisfactory ink absorption properties and inkjet recording properties which produces very little edge dust when cut can easily be obtained, and this invention is therefore of great industrial use.

What is claimed is:

1. A method of manufacturing an inkjet recording cast-coated paper wherein:

a coating solution containing a pigment and a polyvinyl alcohol binder resin is supplied to a base paper, a treatment solution, which comprises a mixed solution of borate and boric acid having a blending ratio by weight of borate to boric acid of from 0.25/1 to 2/1 and having the function of solidifying the binder resin, is supplied to the coating layer while it is still wet in order to solidify the coating layer, and the wet, solidified coating layer is brought into pressure contact with the mirror surface of a heated drum and dried to obtain a cast-coated layer, wherein a treatment solution supply roll is enclosed by the base paper such that the wet coating layer is brought into contact with the treatment solution supply roll and ponds of treatment solution are formed both before and after where the coating layer comes into contact with the treatment solution supply roll.

2. The method of manufacturing the inkjet recording cast-coated paper according to claim 1, wherein said treatment solution is supplied to the ponds from above the treatment solution supply roll so that it falls over the treatment solution supply roll.

3. The method of manufacturing the inkjet recording cast-coated paper according to claim 1, wherein said coating solution contains alumina as the pigment.

4. The method of manufacturing the inkjet recording cast-coated paper according to claim 1, wherein said coating solution and/or treatment solution contains a release agent having a melting point of 90° C.-150° C.

* * * * *

UNITED STATES PATENT AND TRADEMARK OFFICE

CERTIFICATE OF CORRECTION

PATENT NO. : 7,628,886 B2
APPLICATION NO. : 10/509374
DATED : December 8, 2009
INVENTOR(S) : Endo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 959 days.

Signed and Sealed this

Second Day of November, 2010

David J. Kappos

David J. Kappos
*Director of the United States Patent and Trademark Office*